United States Patent [19]

Leyte-Vidal

[11] Patent Number: 4,542,613

[45] Date of Patent: Sep. 24, 1985

[54] PRECAST CONCRETE BUILDING PANEL AND METHOD OF PRODUCING THE SAME

[76] Inventor: Marco A. Leyte-Vidal, 4699 SW. 59 Ave., Miami, Fla. 33155

[21] Appl. No.: 498,600

[22] Filed: May 26, 1983

[51] Int. Cl.[4] ..... E04C 1/00

[52] U.S. Cl. ..... 52/375; 52/576; 52/577; 52/309.12

[58] Field of Search ..... 52/309.4, 309.11, 309.12, 52/309.17, 576, 375, 577

[56] References Cited

U.S. PATENT DOCUMENTS

| | | | |
|---|---|---|---|
| 3,640,040 | 2/1972 | MacLean et al. | 52/576 X |
| 4,041,669 | 8/1977 | Rauenhorst | 52/309.4 X |

FOREIGN PATENT DOCUMENTS

| | | | |
|---|---|---|---|
| 241077 | 7/1965 | Austria | 52/576 |
| 1215332 | 4/1966 | Fed. Rep. of Germany | 52/576 |
| 1196455 | 5/1959 | France | 52/576 |
| 1300074 | 6/1962 | France | 52/576 |
| 750146 | 6/1956 | United Kingdom | 52/576 |

*Primary Examiner*—J. Karl Bell
*Attorney, Agent, or Firm*—John Cyril Malloy

[57] ABSTRACT

Relatively lightweight precast building panels for use as wall, roof or floor sections are provided. Each panel is molded in a form which is generally rectangular in configuration and provides a cavity into which concrete is poured, the floor of the form being comprised of a plurality of recessed styrofoam inlays separated by wood strips such as furring strips which are also used as a separation between the entire inside perimeter of the form and the styrofoam inlays. After the styrofoam inlays and wood strips are placed, concrete is poured into the form and finished off in the conventional manner. The side walls of the form are removed after the cement sets up and there results a concrete building panel with an adhered styrofoam coating permanently bonded over one surface with wood strips around the perimeter thereof and between each pair of styrofoam inlays.

11 Claims, 6 Drawing Figures

PRECAST CONCRETE BUILDING PANEL AND METHOD OF PRODUCING THE SAME

BACKGROUND OF THE PRESENT INVENTION

The present invention pertains to prefabricated concrete building panels having one surface coated with an adhered insulating material, such as styrofoam, permanently bonded to it and which is applied into a form before concrete is poured into it. The form is sized to predetermined dimensions conforming to the size and thickness of the panels to be cast and comprises four side walls which are preferably of steel; and a flat base or floor spans the upright side walls; and upon this floor the styrofoam inserts, generally downwardly opening and box-like in configuration, are placed. The styrofoam inserts are separated by strips of wood such as furring strips which also are placed about the entire inside perimeter of the form to provide a separation between the form and the styrofoam inserts.

It is therefore a principal object of this invention to provide relatively lightweight prefabricated concrete building panels with cast in insulation permanently bonded to the concrete and wood fastening strips for attaching paneling, sheetrock, etc. thereto.

DETAILED DESCRIPTION OF THE DRAWINGS

Figure 1:
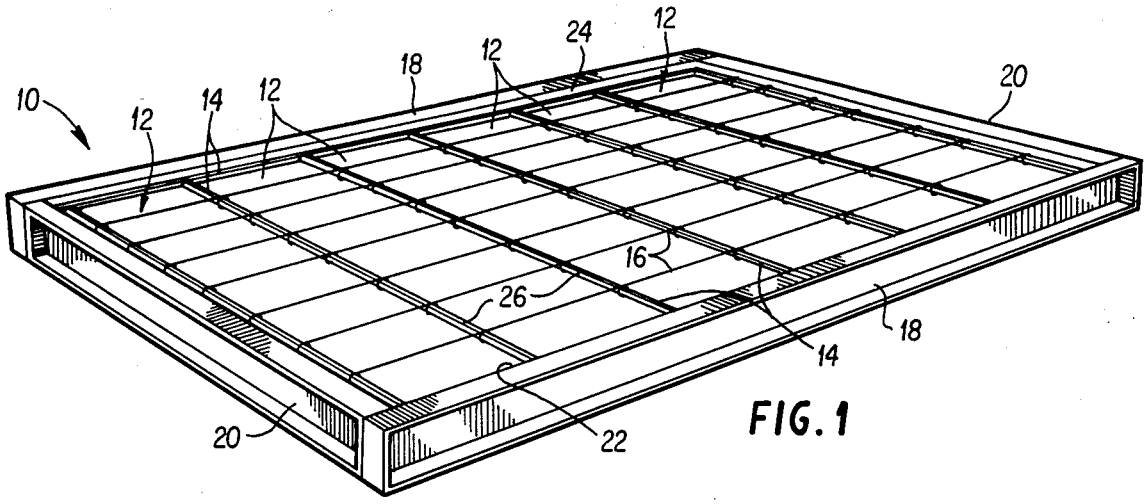
FIG. 1 is a perspective view of a typical form used for precasting the building panels of the present invention with a plurality of box-like styrofoam panels inserted therein and steel reinforcing rods suspended around the inside perimeter of the form and in between each pair of inserts by steel reinforcing wire.
Figure 2:
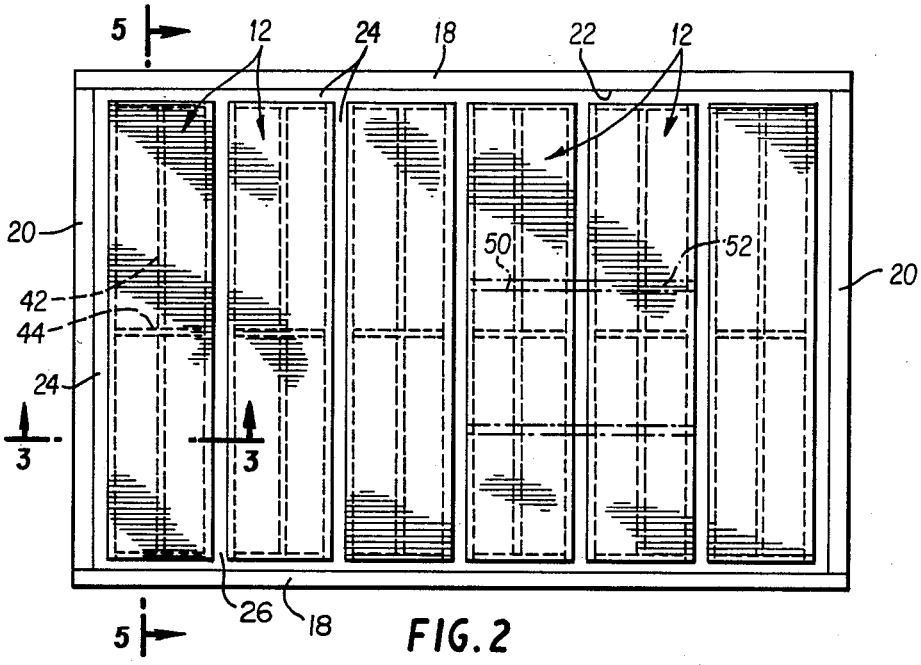
FIG. 2 is a top plan view of FIG. 1 with the steel reinforcing rods and wire removed.

In FIGS. 1 and 2, a typical edge form is shown for precasting the building panels of the present invention and is indicated generally at 10. A plurality of box-like preformed styrofoam inserts 12 are inserted within the confines of the form 10 and steel rods 14 are suspended by steel wires 16 around the inside perimeter of the form 10 and in between each pair of styrofoam inserts.

The edge form 10 is comprised of two pairs of generally parallel opposed rails 18—18 and 20—20 to form a generally rectangular cavity 22 therewithin. Referring to FIG. 2, the preformed box-like styrofoam inserts are sized to provide a space 24 around the entire inside perimeter of the form 10 and the styrofoam inserts are spaced apart to provide the spaces 26 between each pair thereof.

Figure 3:
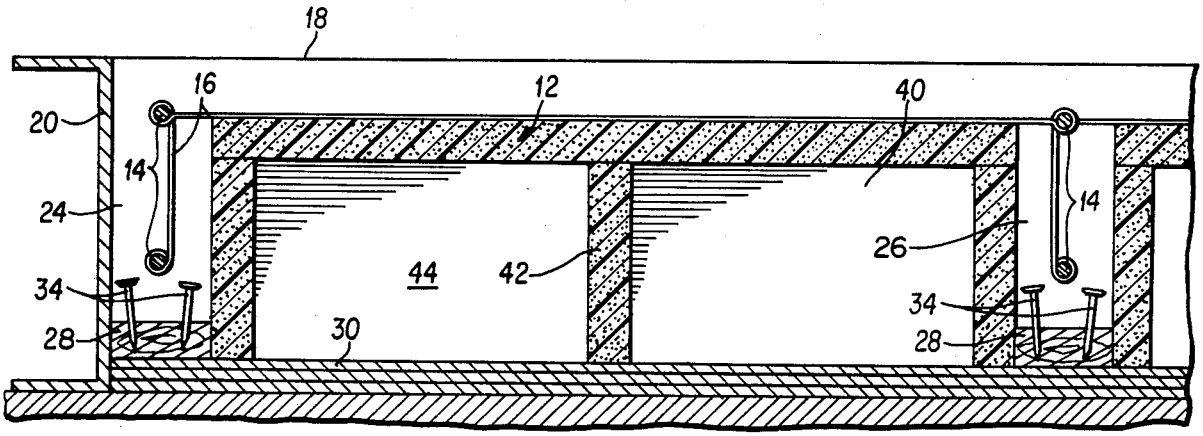
FIG. 3 is an enlarged cross sectional view taken along line 3—3 of FIG. 2.

Referring to FIG. 3, the width of the spaces 24 and 26 is determined by treated wood strips 28 such as furring strips which are placed in abutting relation between the inside perimeter of the form rails 18—18 and 20—20 and the styrofoam inserts 12, and between each pair of styrofoam inserts 12.

Figure 4:
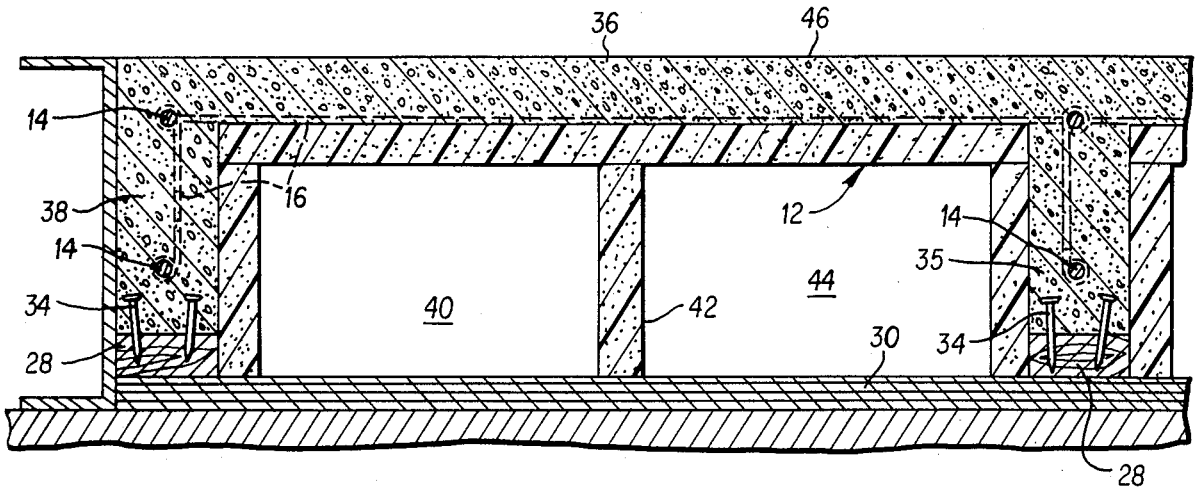
FIG. 4 is a view similar to FIG. 3 after the concrete is poured in the form.
Figure 5:
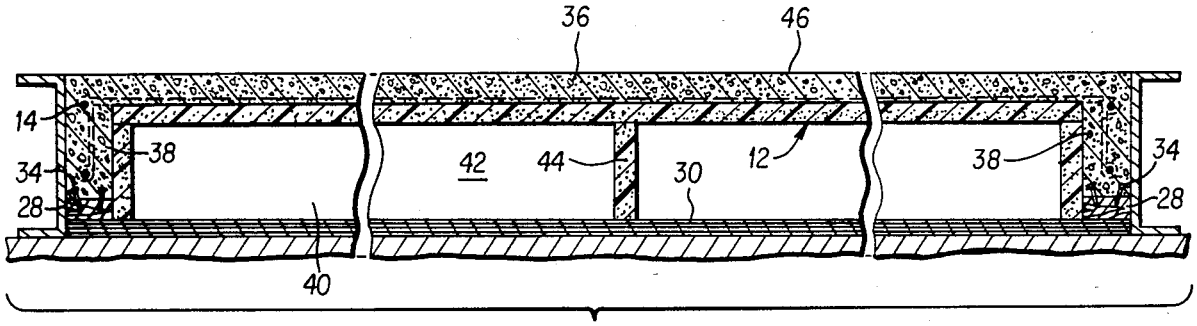
FIG. 5 is a fragmentary cross sectional view taken along line 5—5 of FIG. 2.
Figure 6:
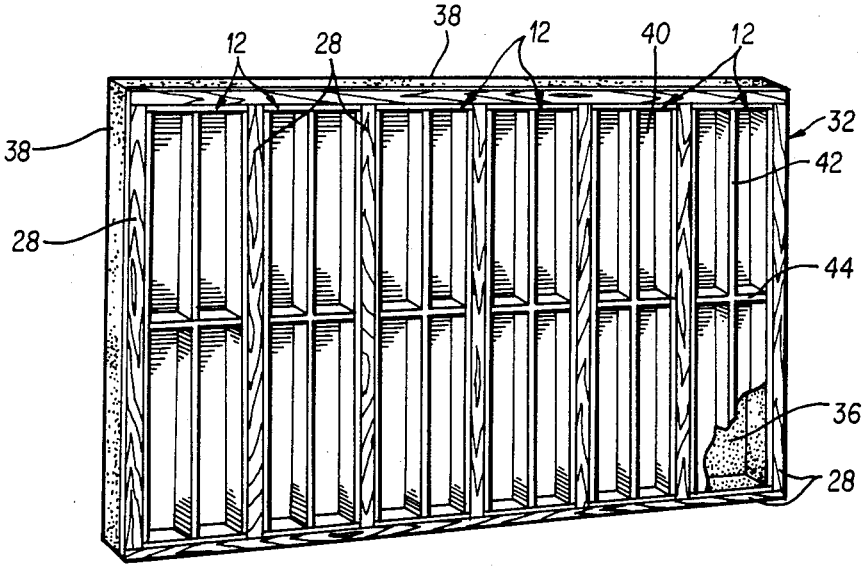
FIG. 6 is a perspective view of the unfinished side of a typical precast panel of the present invention.

A flat base 30 is preferably inserted within the confines of the form 10 to support the styrofoam inserts 12 and wood strips 28 as illustrated in FIGS. 3, 4 and 5. However, the styrofoam inserts 12 and woodstrips 28 comprise the bottom form for the panel 32, FIG. 6. To this end, a plurality of nails 34 are driven into the upper side of the wood strips prior to their being placed in the form 10 and when the concrete 35 is poured into the cavity 22, the nails 34 serves as anchor means for the fastening strips 28 and become embedded thickened concrete beam portions 38 and the wood strips become a part of the finished panel 32.

The steel reinforcing rods 14 are illustrated, in FIGS. 3, 4 and 5 in the cavities 24 and 26, suspended by the steel reinforcing wires 16. As illustrated in FIGS. 4 and 5, after the concrete 35 is poured, relatively thin concrete panel portions 36 are provided over each styrofoam insert 12 while relatively thick, concrete reinforced beams 38 are formed around the perimeter of the panel 32 and in between each styrofoam insert 12.

The styrofoam inserts 12 may be fabricated from strips but are preferably molded to the proper size and shape and are of a depth somewhat less than the depth of the edge form 10, the difference in depth determining the thickness of the concrete portions 36. As stated, the styrofoam inserts are box-like, being open on the unfinished side of the panel, providing cavities 40 in the panel 32. Longitudinal and transverse reinforcing webs 42 and 44 may be provided, as needed, in the styrofoam inserts 12.

After the concrete is poured, the top surface 46 is finished in the conventional manner to the top edge of the form to present a prefinished surface, for instance, for the exterior of a wall, floor or roof and the opposed unfinished side of the panel, presenting the fastening strips 28, may be covered by any appropriate material.

The precast panel as illustrated and described may be made in various sizes and shapes depending upon its application to a particular project. For example, columns may be precast by providing an appropriate form and inserting a single elongated narrow polyfoam insert in the form, the fastening strips may or may not be included depending upon the application of the column in the project at hand.

As illustrated by the dot-dash lines 50 in FIG. 2, any type of appropriate form may be placed in the cavity 22 to provide for desired openings such as window and door openings in the finished panel 32 when the panel is to be used as a wall section. All of the polyfoam inserts 12 adjacent to the window and door forms would be sized to provide a cavity 52 therearound for the reception of wood fastening strips 28 and steel rods 14 to form a concrete perimeter beam similar to the perimeter beam 38 around the entire panel and the beams intermediate each pair of inserts 12.

What is claimed is:

1. A precast concrete building panel, having a predetermined length, width and thickness, for use as wall, roof or floor sections comprising:

(a) a finished planar concrete surface forming a first side of the panel;

(b) box-like insert means for at least partially filling said panel and cast in said panel, said insert means formed of lightweight insulating material in rigid form and having, 1. an open side flush with and at least partially defining a second side of said panel, 2. a closed side disposed a predetermined distance from said planar concrete surface within the thickness of said panel, and 3. opposed side and end walls connecting the periphery of said closed side and extending outwardly to said second panel side, said opposed side and end walls being positioned a predetermined distance inwardly of the periphery of the panel;

(c) a relatively thin concrete panel portion disposed between said closed side of said insert and said finished planar concrete surface;

(d) thickened concrete beam portions extending around the panel between said opposed side and end walls and the periphery of the panels;

(e) a plurality of fastening strips each disposed adjacent one face of said thickened concrete beam portions and an outer peripheral edge of said insert means and extending along the length of the latter, anchor means for securing said fastening strips to said panel and being secured to each of said fastening strips and extending outwardly therefrom into embedded relation within said one thickened concrete beam portion, each of said fastening strips being thereby fixedly disposed in flush relation to and at least partially defining said second side of said panel, and (f) said concrete panel, beam portion, fastening strips and insert means being permanently bonded together and forming an integral one-piece construction of said building panel.

2. A precast concrete building panel as defined in claim 1 wherein said insert means comprises a plurality of insulating inserts disposed in spaced apart, parallel relation, each insert providing an open side flush with said second side of said panel and a closed side extending a predetermined distance within the thickness of said panel to form relatively thin concrete panel portions between said closed sides and said finished planar concrete surface and thickened concrete beam portions extending around the periphery of the panel and in between each pair of said plurality of said insulating inserts.

3. A precast concrete building panel as defined in claim 2 in which each of said insulating inserts is formed of polyurethane foam.

4. A precast concrete building panel as defined in claim 2 including reinforcing steel rods in all of said beam portions.

5. A precast concrete building panel as defined in claim 4 including opening means in the panel to accommodate the installation of any desired doors or windows, steel rod reinforced perimeter beams about said opening means and wood fastening strips on said second side fixed to said opening means perimeter beams.

6. A precast concrete building panel as defined in claim 4 including a plurality of reinforcing steel wires spanning said plurality of insulating inserts and connecting with said reinforcing steel rods.

7. A precast concrete building panel as defined in claim 2 in which each of said box-like insulating inserts includes a longitudinal and a transverse reinforcing web.

8. A method of precasting a concrete building panel having an integral, one-piece construction and including a first side defined by a planar concrete surface and a second side defined by an at least partially open surface, said method including the steps of:

(a) providing an edge formed over a base member, said edge form having a predetermined length, width and depth, (b) providing a plurality of box-like inserts formed of a semi-rigid lightweight insulating foam material and having an open side and a depth somewhat less than the depth of said form and being of a predetermined length and width, (c) lining said plurality of box-like inserts, open side down, on said base member, in a spaced apart, parallel relationship within the cavity formed by said edge form;

(d) placing fastening strips on said base member between said inserts and edge form about the entire inside periphery thereof and between each pair of sid inserts;

(e) pouring concrete into said form to the top edge thereof and finishing the top surface of said concrete to form relatively thin concrete panel portions permanently bonded over each of said inserts and relatively thick beam portions permanently bonded around the entire inner periphery of said form and between each pair of said inserts;

(f) anchoring said fastening strips to said thick beam portions and adjacent said inserts and in flush disposition to said open sides of said inserts so as to at least partially define said second side of said panel; and (g) removing said edge form after the concrete has set up and removing the panel from the base member.

9. A method as defined in claim 8 including securing a plurality of anchoring means partially into the top sides of said fastening strips for anchoring said fastening strips to said thick beam portions before placing said fastening strips in said form.

10. The method as defined in claim 9 suspending steel reinforcing rods over said fastening strips about the entire inner periphery of said edge form and in between each pair of said inserts prior to pouring the concrete.

11. The method as defined in claim 9 including placing form means within the confines of said edge form to provide opening means in the panel to accommodate the installation of any desired doors or windows in the panel and placing wood strips about the periphery of said form means prior to pouring the concrete.

* * * * *